US005612120A

United States Patent [19]

Tago et al.

[11] Patent Number: 5,612,120

[45] Date of Patent: Mar. 18, 1997

[54] THERMAL TRANSFER SHEET

[75] Inventors: Yasuo Tago; Kenji Kurokawa; Naohiro Ikeda, all of Osaka, Japan

[73] Assignee: Fujicopian Co., Ltd., Japan

[21] Appl. No.: 634,916

[22] Filed: Apr. 19, 1996

[30] Foreign Application Priority Data

Apr. 21, 1995 [JP] Japan ..... 7-96925

[51] Int. Cl.[6] ..... B41M 5/26

[52] U.S. Cl. ..... 428/195; 428/484; 428/488.1; 428/913; 428/914

[58] Field of Search ..... 428/195, 484, 428/488.1, 913, 914

[56] References Cited

U.S. PATENT DOCUMENTS 4,965,132 10/1990 Mizobuchi et al. ..... 428/195

*Primary Examiner*—Pamela R. Schwartz
*Attorney, Agent, or Firm*—Fish & Neave

[57] ABSTRACT

A thermal transfer sheet is provided which includes: a base film; and a filling ink layer formed side by side on one side of the base film; the filling ink layer containing an n-paraffin wax in an amount of not less than 10% by weight and an isoparaffin wax in an mount of 20% to 80% by weight of the total amount of the n-paraffin wax and the isoparaffin wax.

5 Claims, 1 Drawing Sheet

THERMAL TRANSFER SHEET

BACKGROUND OF THE INVENTION

The present invention relates to a thermal transfer sheet and, more particularly, to a thermal transfer sheet suitable for formation of a color image on a paper sheet having a low surface smoothness (hereinafter referred to as "rough paper sheet").

When a conventional thermal transfer sheet having a thermally-transferable color ink layer formed on a foundation and containing a wax as a principal component of a vehicle thereof is used for thermal transfer printing on a rough paper sheet, transferred color ink adheres only onto crests of the microscopically undulated surface of the rough paper sheet, but not onto troughs thereof. Therefore, an obtained print image often suffers from a defect or a void.

To overcome this problem, Japanese Unexamined Patent Publication No. 61-225090 (1986) proposes a thermal transfer sheet having a filling ink layer and a thermally-transferable color ink layer formed side by side on a foundation. The filling ink layer is first transferred onto a rough paper sheet to smooth the rough surface of the paper sheet, and then the color ink layer is transferred onto the smoothed surface to form a print image.

Where the color ink layer is transferred onto the filling ink layer preliminarily transferred on the paper sheet to form a print image, however, the gloss of the print image is frequently reduced with the lapse of time.

As a result of an intensive study to identify the cause of the time-related reduction in the gloss of the print image, the present inventors have found that, although a paraffin wax is widely used as a material for the filling ink layer to improve the transferability, the use of the paraffin wax reduces the gloss of the print image with the lapse of time.

In view of the foregoing, it is an object of the present invention to provide a thermal transfer sheet which can prevent the time-related reduction in the gloss of the print image even with a filling ink layer containing a paraffin wax.

The foregoing and other objects of the present invention will be apparent from the following detailed description.

SUMMARY OF THE INVENTION

In accordance with a first feature of the present invention, there is provided a thermal transfer sheet which includes: a base film; and a filling ink layer formed on one side of the base film, the filling ink layer containing an n-paraffin wax in an amount of not less than 10% by weight and an isoparaffin wax in an amount of 20% to 80% by weight of the total amount of the n-paraffin wax and the isoparaffin wax.

In accordance with a second feature of the present invention, the thermal transfer sheet with the first feature is characterized in that the filling ink layer further contains a transparent or white inorganic pigment in an amount of 3% to 60% by weight.

In accordance with a third feature of the present invention, the thermal transfer sheet with the first or second feature is characterized in that the n-paraffin wax has a melting point of 65° C. to 80° C. and the isoparaffin wax has a melting point of 50° C. to 70° C.

In accordance with a fourth feature of the present invention, the thermal transfer sheet with the first, second or third feature is characterized the thermal transfer sheet further comprises a thermally transferable color ink layer provided side by side along with the filling ink layer on the one side of the base film.

In accordance with a fifth feature of the present invention, the thermal transfer sheet with the fourth feature is characterized in that the thermally transferable color ink layer comprises a yellow ink layer, a magenta ink layer and a cyan ink layer.

It has been found that, when a paraffin wax, which contains n-paraffin as a principal component thereof, is used as a material for the filling ink layer, a low-molecular-weight oily component of the n-paraffin wax bleeds out onto the surface of an obtained print image and reduces the gloss of the print image with the lapse of time. Therefore, a specific amount of the isoparaffin wax is mixed with the n-paraffin wax to prevent the oily component of the n-paraffin wax from bleeding, thereby preventing the time-related reduction in the gloss of the print image.

DETAILED DESCRIPTION

Figure 1:
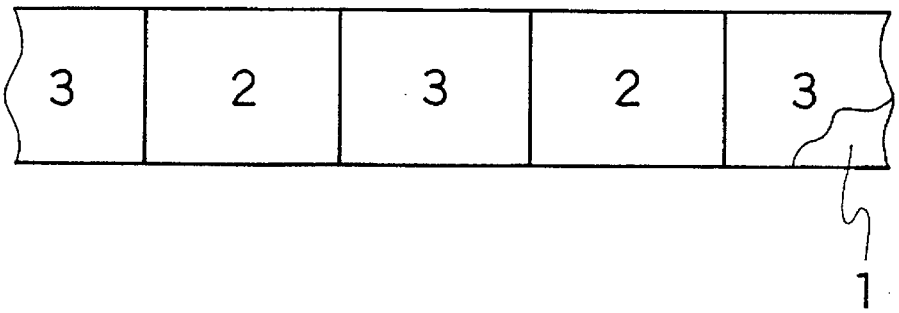
FIG. 1 is a partial plan view illustrating one exemplary arrangement of a filling ink layer and a color ink layer of a thermal transfer sheet in accordance with the present invention.

The present invention will hereinafter be described in detail.

In accordance with the present invention, the filling ink layer contains an n-paraffin wax in an amount of not less than 10% by weight and an isoparaffin wax in an amount of 20% to 80% by weight, preferably 25% to 50% by weight, of the total amount of the n-paraffin wax and the isoparaffin wax.

The n-paraffin wax imparts a particularly excellent transferability to the filling ink layer in comparison with the other waxes. Therefore, the filling ink layer preferably contains the n-paraffin wax in an amount of not less than 10% by weight to exhibit a desired transferability.

However, if the content of the n-paraffin wax in the filling ink layer is not less than 10% by weight, the bleeding of the oily component of the n-paraffin wax onto the surface of the print image is aggravated, thereby reducing the gloss of the print image with the lapse of time.

To prevent the bleeding of the oily component, a specific amount of the isoparaffin wax is mixed with the n-paraffin wax. It is believed that this allows the wax mixture in the filling ink layer to have a micro-crystalline structure so that the oily component of the n-paraffin wax hardly migrates.

If the content of the n-paraffin wax is too high, it is difficult to prevent the bleeding of the oily component. From this point of view, the content of the n-paraffin wax in the filling ink layer is preferably not greater than 50% by weight, especially not greater than 30% by weight.

If the content of the isoparaffin wax is less than the aforesaid range, the bleeding of the oily component of the n-paraffin wax cannot be sufficiently prevented. On the other hand, if the content of the isoparaffin wax is greater than the aforesaid range, the transferability of the resulting filling ink layer is degraded.

The n-paraffin wax and the isoparaffin wax preferably have melting points of 65° C. to 80° C. (particularly 70° C. to 80° C.) and 50° C. to 70° C., respectively. If the melting point of the n-paraffin wax is lower than the above range, the n-paraffin wax contains a large amount of the oily component and, therefore, is not preferable in terms of the prevention of the bleeding. If the melting point of the n-paraffin wax is higher than the above range, the transfer sensitivity of the resulting filling ink layer tends to be reduced. If the melting point of the isoparaffin wax is lower than 50° C., a blocking phenomenon tends to occur when the resulting thermal transfer sheet is stored in a rolled state (or in a pancake form) at a high temperature. If the melting point of the isoparaffin wax is higher than 70° C., the transfer sensitivity of the resulting filling ink layer tends to be reduced.

The transfer sensitivity of the filling ink layer of the present invention can be controlled by using a high-melting-point n-paraffin wax and a low-melting-point isoparaffin wax in combination.

As long as the contents of the n-paraffin wax and the isoparaffin wax in the filling ink layer are within the aforesaid respective preferable ranges, it is not necessarily required to use pure n-paraffin and isoparaffin waxes. For example, a paraffin wax containing n-paraffin as a principal component thereof may be used as the n-paraffin wax, and microcrystalline wax containing isoparaffin as a principal component thereof may be used as the isoparaffin wax.

Other heat-meltable materials may be used for the filling ink layer along with the n-paraffin wax and the isoparaffin wax. Such heat-meltable materials include other waxes and thermoplastic resins.

Examples of specific other waxes include: natural waxes such as haze wax, bees wax, lanolin, carnauba wax, candelilla wax, montan wax and ceresine wax; synthetic waxes such as oxidized waxes, ester waxes, low-molecular-weight polyethylene wax, Fischer-Tropsch wax and α-olefin-maleic anhydride copolymer wax; higher fatty acids such as lauric acid, myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and bisamides such as oleic acid amide. These waxes may be used either alone or in combination.

Examples of specific thermoplastic resins (including elastomers) include olefinic copolymers such as ethylene-vinyl acetate copolymer and ethylene-acrylic ester copolymer, polyamide resins, polyester resins, epoxy resins, polyurethane resins, acryl resins, vinyl chloride resins, cellulose resins, vinyl alcohol resins, petroleum resins, phenol resins, styrene resins, vinyl acetate resins, natural rubbers, styrene-butadiene rubber, isoprene rubber, chloroprene rubber, polyisobutylene and polybutene. These may be used either alone or in combination.

The filling ink layer according to the present invention preferably contains a transparent or white inorganic pigment in an amount of not greater than 60% by weight, more preferably 3% to 60% by weight, still more preferably 3% to 45% by weight, with respect to the total amount of the material of the filling ink layer.

It is presumed that the low-molecular-weight oily component of the n-paraffin wax is absorbed by a surface portion of the inorganic pigment contained in the filling ink layer, so that the oily component is further prevented from bleeding onto the surface of a print image.

If the content of the transparent or white inorganic pigment is less than the aforesaid range, the bleeding-preventive effect is insufficient. On the other hand, if the content of the inorganic pigment is greater than the aforesaid range, the resulting filling ink layer has an increased melt viscosity, so that the transferability and the adhesive strength to the base film are reduced. This results in exfoliation of the filling ink layer from the base film.

The term "transparent or white pigment" herein means a pigment which provides a transparent or white ink when dispersed in a transparent vehicle. It is preferred that the filling ink layer, when transferred onto a paper sheet, is virtually undistinguished from the background color of the paper sheet. To this end, the transparent or white pigment is preferably used.

Examples of the inorganic pigment include silica powder, calcium carbonate, precipitated barium sulfate, magnesium carbonate, alumina and titanium oxide. These inorganic pigments may be used either alone or in combination.

Since the filling ink layer serves to fill up troughs of the microscopically undulated surface of a rough paper sheet to smooth the surface, the melting point and melt-viscosity thereof are preferably 60° to 90° C. and 15 to 2,500 cps/100° C., respectively.

The coating amount of the filling ink layer (on a solid component basis, hereinafter the same) is typically about 2 to about 15 g/m$^2$.

The filling ink layer can be formed on the base film by hot-melt coating or, alternatively, by preparing a coating liquid comprising a solution or dispersion in an organic solvent or an aqueous dispersion (including emulsion) of the aforesaid wax and/or resin components optionally containing an inorganic pigment, then applying the coating liquid on the base film, and drying the applied coating liquid.

In the present invention, a thermally-transferable color ink layer is provided on the base film side by side along with the filling ink layer, as required.

The thermally-transferable color ink layer according to the present invention is composed of a coloring agent and a heat-meltable vehicle. Conventional thermally-transferable color ink layers can be used without any limitation. The heat-meltable vehicle is composed of a wax and/or a thermoplastic resin.

Examples of specific waxes include: natural waxes such as haze wax, bees wax, lanolin, carnauba wax, candelilla wax, montan wax and ceresine wax; petroleum waxes such as n-paraffin wax, isoparaffin wax, paraffin wax and microcrystalline wax; synthetic waxes such as oxidized waxes, ester waxes, low-molecular-weight polyethylene wax, Fischer-Tropsch wax and a-olefin-maleic anhydride copolymer wax; higher fatty acids such as lauric acid, myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and bisamides such as oleic acid amide. These waxes may be used either alone or in combination. Even if an n-paraffin wax or the like containing a low-molecular-weight oily component is used as it is for the heat-meltable vehicle of the color ink layer, the oily component does not bleed onto the surface of a print image because the color ink layer contains a large amount of a pigment or the like.

Examples of specific thermoplastic resins (including elastomers) include olefinic copolymers such as ethylene-vinyl acetate copolymer and ethylene-acrylic ester copolymer, polyamide resins, polyester resins, epoxy resins, polyurethane resins, acryl resins, vinyl chloride resins, cellulose resins, vinyl alcohol resins, petroleum resins, phenol resins, styrene resins, vinyl acetate resins, natural rubbers, styrene-butadiene rubber, isoprene rubber, chloroprene rubber, polyisobutylene and polybutene. These may be used either alone or in combination.

Usable as the coloring agent for the color ink layer are organic pigments and dyes of various types such as carbon black.

Yellow, magenta and cyan coloring agents to be used for the formation of a multi-color or full-color print image by way of the subtractive color mixture are preferably transparent ones.

Examples of specific transparent yellow coloring agents include: organic pigments such as Naphthol Yellow S, Hansa Yellow 5G, Hansa Yellow 3G, Hansa Yellow G, Hansa Yellow GR, Hansa Yellow A, Hansa Yellow RN, Hansa Yellow R, Benzidine Yellow, Benzidine Yellow G, Benzidine Yellow GR, Permanent Yellow NCG and Quinoline Yellow Lake; and dyes such as Auramine. These yellow coloring agents may be used either alone or in combination.

Examples of specific transparent magenta coloring agents include: organic pigments such as Permanent Red 4R, Brilliant Fast Scarlet, Brilliant Carmine BS, Permanent Carmine FB, Lithol Red, Permanent Red F5R, Brilliant Carmine 6B, Pigment Scarlet 3B, Rhodamine Lake B, Rhodamine Lake Y and Arizalin Lake; and dyes such as Rhodamine. These magenta coloring agents may be used either alone or in combination.

Examples of specific transparent cyan coloring agents include: organic pigments such as Victoria Blue Lake, metal-free Phthalocyanine Blue, Phthalocyanine Blue and Fast Sky Blue; and dyes such as Victoria Blue. These cyan coloring agents may be used either alone or in combination.

The term "transparent pigment" herein means a pigment which provides a transparent ink when dispersed in a transparent vehicle.

Where it is difficult to obtain an intense or deep black by superimposing these three color inks (yellow, magenta and cyan inks) by way of the subtractive color mixture, a black ink containing a black coloring agent such as carbon black or Nigrosine Base may be used. Since such a black ink is not to be superimposed with an ink of any other color, the black coloring agent is not necessarily required to be transparent. However, if a color such as blue-black is to be obtained by superimposing the black ink with an ink of any other color, the black coloring agent is preferably transparent.

The content of the coloring agent in the heat-meltable ink layer is preferably about 5% to about 60% by weight.

The color ink layer may contain a dispersant, an antistatic agent and other additives, as required.

In an embodiment of the thermal transfer sheet of the present invention, the color ink layer is formed along with the filling ink layer on a single base film.

Figure 2:
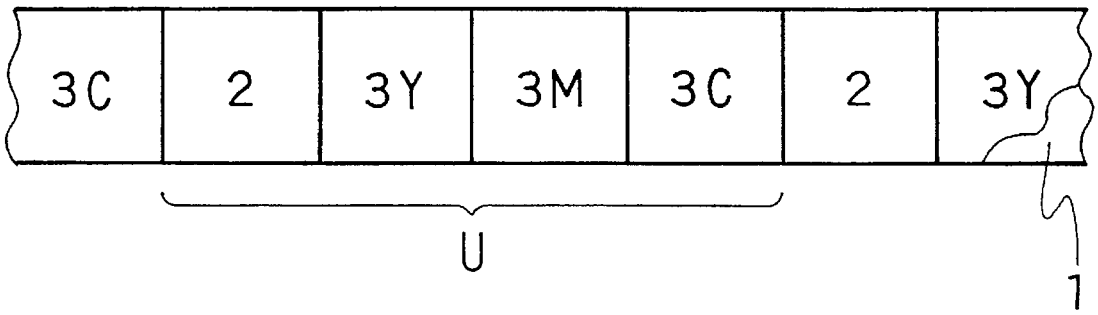
FIG. 2 is a partial plan view illustrating another exemplary arrangement of a filling ink layer and color ink layers of a thermal transfer sheet in accordance with the present invention.

FIG. 1 is a partial plan view illustrating one exemplary arrangement of the ink layers. FIG. 2 is a partial plan view illustrating another exemplary arrangement of the ink layers.

The arrangement shown in FIG. 1 is for the formation of a mono-color print image. A filling ink layer 2 and a color ink layer 3 each having a predetermined size are alternately arranged on a base film 1 in a side-by-side relation. The color ink layer 3 is a mono-color ink layer selected from black, red, blue, green, yellow, magenta and cyan ink layers, for example.

To form a print image by using the thermal transfer sheet shown in FIG. 1, one filling ink layer 2 is overlaid on a paper sheet and transferred thereon by solid-printing by means of a thermal transfer printer. Then, a color ink layer 3 adjacent to the filling ink layer 2 previously used is overlaid on the filling ink layer and transferred thereon in a desired image pattern. Thus, a print image is formed. In turn, a filling ink layer 2 adjacent to the color ink layer 3 previously used is overlaid on another paper sheet, and the aforesaid image formation process is repeated for the formation of another print image.

The arrangement shown in FIG. 2 is for the formation of a multi-color or full-color print image by way of the subtractive color mixture. A filling ink layer 2, a yellow ink layer 3Y, a magenta ink layer 3M and a cyan ink layer 3C each having a predetermined size are repeatedly arranged on a base film 1 in a side-by-side relation in a predetermined repeat unit U. The order these three color ink layers in the repeat unit U is suitably determined in consideration of the order of transfer or superimposition of respective color inks. A black color ink layer may also be included in the repeat unit U.

To form a print image by using the thermal transfer sheet shown in FIG. 2, a filling ink layer 2 in one repeat unit U is overlaid on a paper sheet and transferred thereon by solid-printing by means of a thermal transfer printer. Then, a yellow ink layer 3Y in the same unit U is overlaid on the filling ink layer and transferred thereon in a desired image pattern for the formation of a yellow separation image. Thereafter, a magenta ink layer 3M and a cyan ink layer 3C in the same unit U are sequentially transferred thereon in desired image patterns for the formation of a magenta separation image and a cyan separation image, respectively. Thus, a full-color image is formed. By using an adjacent repeat unit U, another full-color print image is formed on another paper sheet in the same manner as described above.

The order of transfer or superimposition of the yellow ink layer 3Y, the magenta ink layer 3M and the cyan ink layer 3C is arbitrary. In the formation of a multi-color or full-color image, there is a case wherein arbitrary only two color ink layers among the yellow ink layer 3Y, the magenta ink layer 3M and the cyan ink layer 3C are transferred to form arbitrary only two color separation images among the yellow, magenta and cyan separation images.

Usable as the base film for the thermal transfer sheet of the present invention are polyester films such as polyethylene terephthalate film, polyethylene naphthalate film and polyarylate films, polycarbonate films, polyamide films, aramid films and other various plastic films commonly used for the base film of ink ribbons of this type. Thin paper sheets of high density such as condenser paper may otherwise be used. A conventionally known stick-preventive layer may be formed on the back side (the side adapted to come into slide contact with a thermal head) of the base film. Examples of the materials for the stick-preventive layer include heat-resistant various resins such as silicone resin, fluorine-containing resins and nitrocellulose resin, and other resins modified with these heat-resistant resins such as silicone-modified urethane resins and silicone-modified acrylic resins, and mixtures of the foregoing heat-resistant resins and lubricating agents. The thickness of the base film is typically about 1 μm to about 10 μm.

The thermal transfer sheet of the present invention may include only the filling ink layer 2 formed on the base film 1. In such a case, the thermal transfer sheet is used in combination with a thermal transfer recording medium formed with a color ink layer. The filling ink layer is first transferred onto a paper sheet and then the color ink layer is transferred thereon imagewise for the formation of a print image. Alternatively, the thermal transfer sheet is used in combination with a thermal transfer recording medium having a yellow ink layer, a magenta ink layer and a cyan ink layer formed on a single base film or separate base films for the formation of a multi-color or full-color print image.

The present invention will be more fully described by way of examples and comparative examples thereof. It is to be understood that the present invention is not limited to these examples, and various changes and modifications may be made in the invention without departing from the spirit and scope thereof.

EXAMPLES 1 TO 3 AND COMPARATIVE EXAMPLES 1 TO 3

A filling ink having a composition shown in Table 1 and respective color inks having compositions shown in Table 2 were applied in coating amounts of 10 g/m$^2$ and 2 g/m$^2$, respectively, on one side of a 4.5 μm-thick polyethylene terephthalate film provided with a stick-preventive layer composed of a silicone resin on the other side thereof by hot-melt coating. The filling ink layer and the respective color ink layers were arranged as shown in FIG. 2. Thus, thermal transfer sheets of Examples 1 to 3 and Comparative Examples 1 to 3 were prepared.

TABLE 1

| | Ex. 1 | Ex. 2 | Ex. 3 | Com. Ex. 1 | Com. Ex. 2 | Com. Ex. 3 |
|---|---|---|---|---|---|---|
| Composition of filling ink (wt %) | | | | | | |
| n-Paraffin wax (m.p. 76° C.) *1 | | 24 | | | | 44 |
| n-Paraffin wax (m.p. 69° C.) *2 | 24 | | 24 | 44 | 10 | |
| Isoparaffin wax (m.p. 66° C.) *3 | 10 | 20 | 20 | | 52 | |
| Carnauba wax | 4 | 4 | 4 | 4 | 4 | 4 |
| Candelilla wax | 35 | 35 | 35 | 35 | 17 | 35 |
| Ethylene-vinyl acetate copolymer | 17 | 17 | 17 | 17 | 17 | 17 |
| Silica powder | 10 | | | | | |
| Property of filling ink | | | | | | |
| Melting point (°C.) | 67 | 72 | 67 | 68 | 67 | 73 |
| Melt viscosity (cps/100° C.) | 620 | 160 | 150 | 110 | 380 | 120 |

*1 HNP10 available from Nippon Seiro Co., Ltd.
*2 HNP14G available from Nippon Seiro Co., Ltd.
*3 Weisen 0252C available from Nippon Seiro Co., Ltd.

TABLE 2

| Composition of color ink (wt %) | Yellow ink | Magenta ink | Cyan ink |
|---|---|---|---|
| n-Paraffin wax (m.p. 76° C.) | 50 | 50 | 50 |
| Carnauba wax | 10 | 10 | 10 |
| Ethylene-vinyl acetate copolymer | 5 | 5 | 5 |
| Pigment Yellow *1 | 20 | | |
| Brilliant Carmine 6B *2 | | 20 | |
| Cyanine Blue *3 | | | 20 |

*1 Yellow pigment available from Sanyo Color Works, Ltd.
*2 Magenta pigment available from Sanyo Color Works, Ltd.
*3 Cyan pigment available from Sanyo Color Works, Ltd.

By using each of the thermal transfer sheets, a print image was formed. More specifically, a filling ink layer thereof was first transferred onto a paper sheet (XEROX 4024, Bekk smoothness: 40 sec) by solid printing by means of a thermal transfer printer (PHASER 200 available from Techtronics Inc.). Then, a yellow ink layer, a magenta ink layer and a cyan ink layer thereof were transferred successively and superimposed on the filling ink layer transferred on the paper sheet by solid printing. The print image thus obtained was evaluated as follows. The results are shown in Table 3.

(1) Time-related change in gloss of print image

The gloss of each of the obtained print images was measured by means of a digital gloss meter (GM-26D available from Kabushiki Kaisha Murakami Shikisai Gijutsu Kenkyusho) immediately after the formation of the print images, and one day, three days and ten days thereafter.

(2) Transferability of filling ink layer

Only a filling ink layer of each of the thermal transfer sheets was transferred onto the above-mentioned paper sheet by solid printing in the same manner as described above, and the transferability thereof was determined by the following two methods.

(a) Transferred amount

The amount of filling ink left untransferred in the thermal transfer sheet was measured to determine the amount (g/m$^2$) of transferred filling ink.

(b) Smoothness

The smoothness of the paper sheet which received the filling ink layer transferred thereon was measured by means of a Bekk smoothness meter.

TABLE 3

| | Gloss | | | | Transferability | |
|---|---|---|---|---|---|---|
| | Immediately after image formation | After one day | After three days | After ten days | Transferred amount (g/m$^2$) | Smoothness (sec) |
| Ex. 1 | 72 | 70 | 69 | 69 | 10 | 420 |
| Ex. 2 | 71 | 70 | 68 | 68 | 9 | 380 |
| Ex. 3 | 72 | 68 | 65 | 64 | 10 | 410 |
| Com. Ex. 1 | 73 | 62 | 51 | 32 | 10 | 420 |
| Com. Ex. 2 | 72 | 70 | 70 | 69 | 6 | 160 |
| Com. Ex. 3 | 70 | 62 | 54 | 44 | 6 | 170 |

In addition to the materials and ingredients used in the Examples, other materials and ingredients can be used in Examples as set forth in the specification to obtain substantially the same results.

As described above, the thermal transfer sheet of the present invention which includes the filling ink layer which is to be first transferred on a rough paper sheet, and the color ink layer which is to be thereafter transferred thereon for the formation of a print image, is free from the time-related reduction in the gloss of the print image, even though the filling ink layer contains an n-paraffin wax for improvement of the transferability thereof.

What we claim is:

1. A thermal transfer sheet comprising:

a base film; and a filling layer provided on one side of the base film;

the filling layer containing an n-paraffin wax in an amount of not less than 10% by weight and an isoparaffin wax in an amount of 20% to 80% by weight of the total amount of the n-paraffin wax and the isoparaffin wax.

2. The thermal transfer sheet of claim 1, wherein the filling layer further contains a transparent or white inorganic pigment in an amount of 3% to 60% by weight.

3. The thermal transfer sheet of claim 1, wherein the n-paraffin wax has a melting point of 65° C. to 80° C., and the isoparaffin wax has a melting point of 50° C. to 70° C.

4. The thermal transfer sheet of claim 1, which further comprises a thermally transferable color ink layer provided side by side along with the filling layer on the one side of the base film.

5. The thermal transfer sheet of claim 4, wherein the thermally transferable color ink layer comprises a yellow ink layer, a magenta ink layer and a cyan ink layer.

* * * * *

UNITED STATES PATENT AND TRADEMARK OFFICE

CERTIFICATE OF CORRECTION

PATENT NO : 5,612,120

DATED : March 18, 1997

INVENTION(S) : Yasuo Tago, et al.

It is certified that error appears in the above-identified patent and that said Letters Patent are hereby corrected as shown below:

Cover page, Item [57], line 5 delete "mount" and substitute therefor -- amount --.

Column 1, line 67 after "characterized" insert -- in that --.

Column 5, line 6 after "organic" insert -- and inorganic --.

Signed and Sealed this

Nineteenth Day of December, 2000

*Attest:*

*Attesting Officer*

Q. TODD DICKINSON

*Commissioner of Patents and Trademarks*